United States Patent [19]

Chow et al.

[11] 4,345,980

[45] Aug. 24, 1982

[54] ELECTROWINNING OF ZINC

[75] Inventors: Richard T. Chow; Clifford J. Krauss; Douwe Ybema, all of Trail, Canada

[73] Assignee: Cominco Ltd., Canada

[21] Appl. No.: 158,711

[22] Filed: Jun. 12, 1980

[30] Foreign Application Priority Data

Feb. 19, 1980 [CA] Canada ..... 345935

[51] Int. Cl.[3] ..... C25C 1/16

[52] U.S. Cl. ..... 204/119

[58] Field of Search ..... 204/114, 115, 119

[56] References Cited

U.S. PATENT DOCUMENTS

| | | | |
|---|---|---|---|
| 3,799,850 | 3/1974 | Entshev et al. | 204/119 |
| 3,969,203 | 7/1976 | Ramirez | 204/149 |
| 4,153,522 | 5/1979 | Arbiter et al. | 204/115 |

FOREIGN PATENT DOCUMENTS

| | | | |
|---|---|---|---|
| 838099 | 3/1970 | Canada | 204/115 |

OTHER PUBLICATIONS

Metal Finishing, Jan. 1979, vol. 77, No. 13, pp. 130 & 132.

Thompson, Theoretical & Applied Electrochemistry, Revised Ed., N.Y., The Macmillan Co., 1925, pp. 212–213.

*Primary Examiner*—Howard S. Williams

*Attorney, Agent, or Firm*—Wenderoth, Lind & Ponack

[57] ABSTRACT

In the process for electrowinning of zinc from acid zinc sulfate electrolyte, electrolyte is recirculated to the cells and a portion of the electrolyte is returned to the leaching operation of zinc-bearing material. By only returning electrolyte that overflows from electrolytic cells that contain new and/or recently cleaned anodes to the leaching operation, the amount of sludge in the cells can be reduced, the period between cleanings of cells can be lengthened and the amount of addition agent for controlling the lead content of deposited zinc can be reduced. Electrolyte overflowing from only those cells that contain new and/or recently cleaned anodes is diverted and kept separate from recirculating electrolyte from all other cells by providing separate means for collecting and transferring electrolyte to the leaching operation. Such means may consist of two separate overflow pipes in the cell overflow means, and shut-off means, whereby electrolyte can be directed either into the recirculation circuit or to the leaching operation, or both, as required.

4 Claims, No Drawings

ELECTROWINNING OF ZINC

BACKGROUND OF THE INVENTION (a) Field of the Invention

This invention relates to an improvement in the electrowinning of zinc from acid zinc sulfate solution.

(b) Description of the Prior Art

In the process for the recovery of zinc from acid zinc sulfate solution, zinc calcine or zinc concentrate is leached at elevated temperature and at atmospheric or elevated pressure with return sulfuric acid or spent electrolyte from the electrowinning process. The leach solution is neutralized and subjected to a number of purification steps using manganese dioxide and zinc dust, and the purified solution is subjected to electrolysis for the electrowinning of zinc. Electrolysis is carried out in electrolytic cells, using aluminum cathodes and lead-silver anodes. Addition agents such as glue and strontium or barium carbonate are used to obtain even deposits of substantially pure zinc. A zinc deposition period of between 24 and 72 hours is normally used, after which cathodes are removed from cells for the recovery of deposited zinc and are replaced with fresh cathodes. Anodes are removed periodically for cleaning and are subsequently returned to the cells. The time between cleanings of anodes varies but is usually between three and ten weeks. The electrolytic cells are periodically shut down and cleaned to remove cell mud. Electrolyte overflows from the cells and is usually recirculated in a closed circuit. If necessary, the recirculation circuit comprises a heat exchanger to cool the circulating electrolyte. A portion of the recirculating electrolyte is normally bled from the system and returned as return acid or spent electrolyte to the leaching operation of calcine or concentrate.

The process, as generally described above, is disclosed in Zinc, C. H. Mathewson, an A.C.S. Monograph, Reinhold Publishing Corporation, New York, 1959, pages 174,225, and is used with minor variations in most electrolytic zinc plants in the world. The circulation of electrolyte, specifically, is disclosed in U.S. Pat. No. 1,282,521 according to which metals are recovered in a process consisting of leaching metalliferous material with spent electrolyte, electrolyzing the leach solution, circulating electrolyte through the electrolytic cells and withdrawing a portion of the circulating electrolyte for return to the leach.

During electrolysis of purified acid zinc sulfate solution, a sludge forms which mainly consists of manganese dioxide, precipitated compounds such as barium or strontium sulfate and calcium sulfate, and precipitated anode corrosion products, such as lead sulfate and lead oxides. A major portion of the formed sludge settles in the bottom of the cells, while a minor portion remains suspended in the circulating electrolyte. Only a part of this minor portion is removed with electrolyte that is returned to the leaching operation and the remainder is recirculated. According to U.S. Pat. No. 2,072,811, there is disclosed a method for electrolyzing a sludge-free zinc-containing electrolyte comprising passing electrolyte through an electrolytic cell with sufficient velocity to carry formed sludge from the cell and contacting the electrolyte-containing sludge with zinc-bearing material to dissolve zinc in electrolyte. The method of sludge removal according to this last named patent is quite impractical, because the flow velocities that are required to remove all sludge from the cell would be undesirably high. Consequently, in most commercial zinc electrowinning plants, sludge formed during electrolysis and not adhering to the anodes settles in the electrolytic cells. This necessitates periodic cleaning of cells.

We have observed, however, that the formation of a major portion of sludge occurs in cells that contain new anodes and/or anodes that have been recently cleaned. We have also found that electrolyte overflowing from these cells contains a quantity of sludge particles that is considerably higher than electrolyte overflowing from cells that contain anodes which have been in operation for at least one day. Moreover, we have observed that the rate of corrosion of anodes is highest for new and recently cleaned anodes and that the corrosion rate decreases sharply after the new and recently cleaned anodes have been in use for about one day. As a result, the consumption of addition agents such as barium or strontium carbonate to control the lead content in electrolyte and deposited zinc is highest in cells containing new and recently cleaned anodes.

SUMMARY OF THE INVENTION

We have now discovered that the amount of sludge in the electrolytic cells can be reduced, the period between cleanings of a cell lengthened and the amount of added barium carbonate or strontium carbonate reduced, when only electrolyte overflowing from cells containing new and/or recently cleaned anodes is returned to the leaching operation of zinc-bearing material.

Accordingly, there is provided in the process for the electrowinning of zinc by leaching zinc-bearing material with spent electrolyte containing sulfuric acid, purifying resulting leach solution, electrolyzing purified solution in a multiplicity of electrolytic cells containing cathodes and anodes for the deposition of zinc on the cathodes, recirculating electrolyte overflowing from the cells, returning a portion of recirculating electrolyte as spent electrolyte to said leaching, and periodically replacing anodes in the cells; the improvement which comprises selecting as spent electrolyte the returning electrolyte overflowing from cells containing anodes chosen from new or recently cleaned anodes.

In another aspect, this invention provides an apparatus for the recovery of zinc comprising in combination a leaching unit and an electrowinning unit; said electrowinning unit including a multiplicity of electrolysis cells having electrolyte inlet means and electrolyte overflow means; an electrolyte recirculation circuit connecting said electrolyte overflow means with said electrolyte inlet means; transfer means for diverting electrolyte from said recirculation circuit to said leaching unit, said transfer means being connected between said overflow means and said leaching unit; means for diverting overflowing electrolyte into said recirculation circuit; and means for diverting electrolyte overflowing from any selected electrolysis cell into said transfer means.

DESCRIPTION OF THE PREFERRED EMBODIMENTS

The invention will now be described in detail with reference to the preferred embodiment of the invention. Purified acid zinc sulfate solution is electrolyzed in a multiplicity of electrolytic cells arranged in parallel groups of rows of cells. Electrolyte is fed to each cell, flows through the cell and overflows into a closed recirculation circuit for return of the electrolyte to the cells. Cell overflow is collected in a surge tank which is positioned in the recirculation circuit. Fresh or neutral electrolyte and the required amounts of addition agents are added at a desirable point, e.g., to the surge tank. Electrolyte is pumped from the surge tank to a heat exchanger such as a cooling tower wherein the temperature of electrolyte is adjusted to within the desired range of 25° to 40° C., preferably in the range of about 25° to 30° C. Electrolyte from the heat exchanger is subsequently distributed to each electrolytic cell. The volume of electrolyte overflowing from the cells may be regulated by adjusting the cell feed and the volume should be sufficient to maintain the zinc tenor and the temperature of the electrolyte at the desired values.

The anodes in the electrolytic cells are cleaned periodically to remove material, such as manganese dioxide, adhering to the surfaces of the anodes. The frequency of cleaning, i.e. the anode cycle, is related to the composition and temperature of the electrolyte, the current efficiency and the lead content of deposited zinc.

The number of anodes in the electrolytic cells, the anode cycle and the anode service-life determine the number of anodes which must be replaced with new anodes or freshly cleaned anodes each day and the number of cells which must each day be provided with new and/or freshly cleaned anodes. The cleaning of anodes may be performed by any one of a number of suitable methods. We prefer to clean the anodes mechanically. Thus, the anodes are removed from cells at the end of the anode cycle, bad anodes are replaced with new anodes as required, while the remaining anodes are cleaned. New and/or freshly cleaned anodes are returned to the cells. In an efficient operation the number of new anodes is very small compared to the number of freshly cleaned anodes. Throughout the electrolysis operation, a number of cells are temporarily subjected to the changing from used anodes at the end of the anode cycle to new and/or freshly cleaned anodes.

According to the invention, electrolyte overflowing from cells, which contain new and/or recently cleaned anodes, i.e., anodes that are new or have been freshly cleaned and have been in use for a period of time in the range of about one-half to two days, preferably about one to one and one-half days, is returned as return acid or spent electrolyte to the leaching operation. This volume of return acid is diverted from and kept separate from the electrolyte that overflows from all other cells into the recirculation circuit. The diversion and separateness of this volume of return acid is achieved by providing means to transfer electrolyte overflowing from cells containing new and/or recently cleaned anodes to the leaching operation. Such transfer means for electrolyte to the leaching plant may comprise a separate system of piping, which connects the overflow means of each cell with the leaching plant. Means are provided to make it possible to direct cell overflow to the recirculation circuit or to the transfer means for return acid.

In a preferred embodiment, the cell overflow means comprises two separate overflow pipes. The first overflow pipe is connected to the recirculation circuit and the second overflow pipe is connected to the transfer means for return acid to the leaching operation. Shut-off means, such as a plug, a stopper or a valve is provided which can be used to cause the cell to overflow into the circulation circuit or to the leaching operation, or both as desired. Thus, the electrolyte overflowing from a cell can be directed entirely into the recirculation circuit for return to the cells by shutting off the overflow into the second overflow pipe, or entirely into the transfer means for return acid by shutting off the overflow into the first overflow pipe, or the overflow can be split and directed into both the recirculation circuit and into the transfer means. The dimensions of the overflow pipes are chosen such that all of the cell overflow can be accommodated by each overflow pipe. Preferably, the dimensions of the overflow pipes are the same so that, when no shut-off means are used, the cell overflow divides in approximately equal portions between the two overflow pipes.

The volume of electrolyte returned to the leaching operation must preferably be approximately the same as the volume of fresh electrolyte added to the process. To compensate for evaporation losses and losses caused by electrolysis, a volume of make-up water may be added.

The invention will now be illustrated by means of the following non-limitative examples.

COMPARATIVE EXAMPLE

This example illustrates the operation of a unit of 30 electrolytic cells in an existing commercial zinc electrowinning plant. The cells are arranged in two rows of 15 cells, each containing 49 anodes and 48 cathodes. The unit was operated according to the conventional method of operation which consisted of feeding 180 L/min electrolyte from the closed electrolyte recirculation circuit to each cell. All of the cell overflow was recirculated at a rate of 5400 L/min. A bleed stream from the recirculation circuit was returned to the leaching operation at a rate of 270 L/min., while fresh, neutral electrolyte was added to the recirculation circuit at a rate of 270 L/min. The anode cleaning cycle was 42 days. To control the lead content in the electrolyte and the deposited zinc, 2.2 kg barium carbonate per ton of deposited zinc was continuously added. Over a 6 week period, the lead content of deposited zinc was determined after each deposition cycle. The lead content averaged 15 ppm. The unit was operated for a further period but without the addition of barium carbonate. The average lead content of the zinc deposited during this further period had increased to 23.9 ppm.

EXAMPLE 1

This example relates to the unit of 30 electrolytic cells as described in the Comparative Example but modified to practise the method according to the invention. Electrolyte feed to each cell is provided from a closed electrolyte recirculation circuit comprising a surge tank and a heat exchanger. Electrolyte overflows from each cell into an overflow means which comprises two overflow pipes, one connected to the recirculation circuit, the other connected to piping for transferring overflow to the leaching operation of zinc-containing material. Stoppers are provided to shut off the overflow of electrolyte through either one of the overflow pipes.

The unit was operated with a flow of neutral (fresh) electrolyte to the surge tank of 270 L/min. and a flow of recirculated electrolyte to each cell of 180 L/min. The overflow of electrolyte from each cell into the recirculation circuit was 180 L/min. for a total electrolyte circulation rate of 5400 L/min. The total flow of return acid to the leaching operation was 270 L/min.

The cleaning of anodes was carried out for 5 days per week and an anode cycle of 42 days was used. This made it necessary to clean and replace the 49 anodes of one cell for each one of the 5 days. In order to obtain the return acid flow of 270 L/min. and maintain a circulation of 180 L/min. per cell, the full overflow from one cell and one half of the overflow from a second cell were diverted to the leaching operation.

In the continuous electrolysis process, this "1½" overflow from two cells was achieved by shutting off the overflow to the recirculation circuit in the cell wherein the anodes had been replaced with freshly cleaned anodes and keeping the overflow pipe for return acid open for the first day of operation causing a flow of return acid of 180 L/min., and keeping both overflow pipes open in the cell wherein anodes had been cleaned the previous day causing a flow of electrolyte of 90 L/min. to the leaching operation and 90 L/min. to the recirculation circuit. The schedule of operation for cleaning anodes and of flows of recirculating electrolyte and return acid may be further illustrated by the following table.

SCHEDULE OF OPERATION FOR CLEANING ANODES AND RETURN ACID

| Day | M | T | W | T | F | S | S | M | T | T | F | S | S |
|---|---|---|---|---|---|---|---|---|---|---|---|---|---|
| Week | ← | ← | ← | 1 | → | → | → | ← | 2→ | → | 6 | → | → |
| Anodes Cleaned in Cell No. | 1 | 2 | 3 | 4 | 5 | — | — | 6 | 7 | 29 | 30 | — | — |
| Return Acid in L/min | 90 | 90 | 90 | 90 | 90 | 90 | 90 | 90 | 90 | 90 | 90 | 90 | 90 |
| from Cell No. | 30 | 2 | 2 | 4 | 4 | 4 | 4 | 5 | 6 | 28 | 29 | 29 | 29 |
| and L/min | 180 | 180 | 180 | 180 | 180 | 180 | 180 | 180 | 180 | 180 | 180 | 180 | 180 |
| from Cell No. | 1 | 2 | 3 | 4 | 5 | 5 | 5 | 6 | 7 | 29 | 30 | 30 | 30 |

EXAMPLE 2

The modified unit of electrolytic cells was operated for a 6 week period as described in Example 1 with the addition of 1 kg barium carbonate per ton of deposited zinc. The average lead content of the deposited zinc was determined after each deposition cycle. The average lead content was 8.9 ppm. The addition of barium carbonate was subsequently halted and the operation of the unit continued for a 3 week period. The average lead content of the deposited zinc increased to 13.9 ppm.

By comparing the results of the Comparative Example and Example 2, it can be seen that the lead content of deposited zinc can be reduced by diverting electrolyte overflowing from cells that contain recently cleaned anodes to the leaching operation. It can also be seen that the amount of added addition agent for the control of lead content in deposited zinc can be considerably reduced while maintaining a low lead content in the deposited zinc.

A natural result of operating the plant according to the process of the invention would be that, during long periods of operation, the accumulation of solids would be significantly decreased, consequently requiring less frequent cleaning of the cells.

It will be understood of course that modifications can be made in the embodiment of the invention illustrated and described herein without departing from the scope and purview of the invention as defined by the appended claims.

What we claim is:

1. In the continuous operation of a process for the electrowinning of zinc comprising leaching zinc-bearing material with spent electrolyte containing sulfuric acid to provide an acid zinc sulphate containing solution; purifying the resulting leach solution to remove undesirable impurities therefrom; incorporating the purified leach solution in the electrolyte in a multiplicity of electrically interconnected cells each containing a plurality of anodes and of cathodes for the deposition of zinc from the electrolyte; recirculating electrolyte overflowing from the cells; returning a portion of the electrolyte circulating through the cells as spent electrolyte to said leaching; periodically removing at least some of the anodes in some of the cells; cleaning or replacing the removed anodes as necessary; returning the fresh or cleaned anodes into the cells from which anodes were removed whereby all of the anodes are periodically removed and replaced during the electrowinning process; the improvement which comprises: returning as spent electrolyte to the leaching process the electrolyte overflowing from only those cells containing at least some replaced or freshly cleaned anodes.

2. The improvement as claimed in claim 1, wherein electrolyte is returned to said leaching for a period of time in the range of about one half day to two days after said anodes have been returned.

3. A process for the electrowinning of zinc from acid zinc sulfate solution in a multiplicity of cells each containing a plurality of anodes and of cathodes, which process comprises: leaching zinc-bearing material with spent electrolyte containing sulfuric acid to provide an acid zinc sulfate solution; purifying the resulting leach solution to remove undesirable impurities therefrom; feeding a volume of purified leach solution as fresh electrolyte combined with recirculating electrolyte to each of said multiplicity of cells; electrolysing said combined electrolyte for deposition of zinc onto the cathodes; periodically removing at least some of the anodes from some of the cells at the end of the anode cycle, cleaning or replacing, as necessary, the removed anodes in a cyclical fashion whereby all of the anode in all of the cells are replaced in turn during said anodes cycle; returning cleaned or replaced anodes to the cells and returning electrolyte overflowing from only those cells containing freshly cleaned or replaced anodes as said spent electrolyte, the volume of electrolyte returning to the leaching as spent electrolyte being about equal to the volume of fresh electrolyte fed to said multiplicity of cells.

4. The process as claimed in claim 1, 2 or 3, wherein electrolyte overflowing from cells containing recently cleaned anodes is returned to said leaching for a period of time in the range of about one to one and one half day after said cleaned anodes have been returned to the cells.

* * * * *